US006233927B1

(12) United States Patent
Hirota et al.

(10) Patent No.: US 6,233,927 B1
(45) Date of Patent: May 22, 2001

(54) EXHAUST GAS PURIFICATION DEVICE

(75) Inventors: Shinya Hirota, Susono; Toshiaki Tanaka, Numazu; Nobumoto Ohashi, Susono; Kazuhiro Itoh, Mishima; Eiji Iwasaki, Susono; Kouji Yoshizaki, Numazu, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/362,287

(22) Filed: Jul. 27, 1999

(30) Foreign Application Priority Data

Jul. 28, 1998 (JP) ..... 10-213140

(51) Int. Cl.[7] ..... F01N 3/00

(52) U.S. Cl. ..... 60/297; 60/295; 60/288; 60/291; 60/301; 60/311; 55/DIG. 30

(58) Field of Search ..... 60/297, 295, 288, 60/291, 301, 278, 300; 55/DIG. 30

(56) References Cited

U.S. PATENT DOCUMENTS

| | | | | |
|---|---|---|---|---|
| 4,485,621 | * | 12/1984 | Wong et al. | 60/288 |
| 5,473,890 | * | 12/1995 | Takeshima et al. | 60/301 |
| 5,524,433 | * | 6/1996 | Adamczyk et al. | 60/277 |
| 5,603,216 | * | 2/1997 | Guile et al. | 60/288 |
| 5,713,199 | * | 2/1998 | Takeshima et al. | 60/277 |
| 5,738,832 | * | 4/1998 | Dogahara et al. | 60/297 |
| 5,937,637 | * | 8/1999 | Fujishita et al. | 60/288 |
| 5,974,791 | * | 11/1999 | Hirota et al. | 60/301 |

FOREIGN PATENT DOCUMENTS

| | | | | |
|---|---|---|---|---|
| 0020766 | | 1/1981 | (EP) . | |
| 0540280 | | 5/1993 | (EP) . | |
| 0758713 | | 2/1997 | (EP) . | |
| 358222907A | * | 12/1983 | (JP) | 60/288 |
| 406066133A | * | 3/1994 | (JP) | 60/300 |
| 406229324A | * | 8/1994 | (JP) | 60/278 |
| 6346768A | | 12/1994 | (JP) . | |
| 07174018A | * | 7/1995 | (JP) . | |
| 953442A | | 2/1997 | (JP) . | |

OTHER PUBLICATIONS

Patent Abstracts Of Japan, vol. 018, No. 691 (M–1731), Dec. 26, 1994 (Dec. 12, 1994) & JP 06 272541 A (Toyota Motor Corp.), Sep. 27, 1994 (Sep. 27, 1994).

* cited by examiner

*Primary Examiner*—Thomas Denion
*Assistant Examiner*—Thai-Ba Trieu
(74) *Attorney, Agent, or Firm*—Kenyon & Kenyon

(57) ABSTRACT

According to the present invention, there is provided an exhaust gas purification device, comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ absorbed therein when a concentration of the oxygen in the exhaust gas flowing into the $NO_x$ absorbent decreases, a trapping element arranged in the exhaust passage upstream of the $NO_x$ absorbent for trapping particulates, a processing element for processing the particulates trapped in the trapping element to regenerate the trapping element, and a preventing element for preventing the exhaust gas from flowing into the $NO_x$ absorbent from the trapping element when the trapping element is regenerated.

12 Claims, 8 Drawing Sheets

EXHAUST GAS PURIFICATION DEVICE

BACKGROUND OF THE INVENTION

1. Field of the Invention

The invention relates to an exhaust gas purification device.

2. Description of the Related Art

For example, Unexamined Japanese Patent Publication No. 9-53442 discloses an exhaust gas purification device, which comprises an absorbent arranged in an exhaust passage of an engine for absorbing $NO_x$ when an air-fuel ratio of an exhaust gas flowing thereinto is lean, the absorbent discharging $NO_x$ absorbed therein when a concentration of an oxygen in the exhaust gas decreases. The absorbent is used in an engine which discharges an exhaust gas, the air-fuel ratio of which is lean in the major range of the engine operation.

As mentioned above, the absorbent discharges $NO_x$ absorbed therein when the concentration of the oxygen in the exhaust gas is decreased by HC and CO, and the absorbent purifies $NO_x$ with HC and CO. Further, the purification device comprises a trapping filter arranged in the exhaust passage upstream of the absorbent for trapping exhaust particulates.

The absorbent may also absorb $SO_x$ in the exhaust gas. In this case, the capacity of the absorbent to absorb $NO_x$ therein is decreased. However, $SO_x$ may absorb on the particulates trapped in the trapping filter. Thus, in the above purification device, $SO_x$ does not flow into the absorbent. Therefore, the trapping filter can maintain the capacity of the absorbent to absorb $NO_x$ therein.

The particulates may clog the trapping filter. In this case, the trapping filter restricts the flow of the exhaust as to the downstream of the trapping filter. To prevent this restriction, the trapping filter is regenerated by burning the particulates in the trapping filter when a predetermined period has elapsed.

$SO_x$ adsorbed on the particulates is discharged from the trapping filter when the trapping filter is regenerated. Thus, the capacity of the absorbent to absorb $NO_x$ is decreased when the trapping filter is regenerated.

Therefore, the object of the invention is to prevent the capacity of the absorbent to absorb $NO_x$ from being decreased when the trapping filter is regenerated.

SUMMARY OF THE INVENTION

According to the invention, there is provided an exhaust gas purification device comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ absorbed therein when a concentration of the oxygen in the exhaust gas flowing into the $NO_x$ absorbent decreases, a trapping element arranged in the exhaust passage upstream of the $NO_x$ absorbent for trapping particulates, a processing element for processing the particulates trapped in the trapping element to regenerate the trapping element, and a preventing element for preventing the exhaust gas from flowing into the $NO_x$ absorbent from the trapping element when the trapping element is regenerated.

Further, according to the invention, the preventing element has an exhaust gas bypass passage branched from a portion of the exhaust passage between the trapping element and the absorbent for bypassing the $NO_x$ absorbent, and a flow direction changing valve for changing a flow direction of the exhaust gas between the flow directions directed to the $NO_x$ absorbent and to the exhaust gas bypass passage, and the flow direction changing valve is controlled to change the flow direction of the exhaust gas from the flow direction directed to the $NO_x$ absorbent to the flow direction directed to the exhaust gas bypass passage when the regeneration of the trapping element is carried out.

Further, according to the invention, the trapping element has a trapping filter.

Further, according to the invention, the processing element has a heater for heating the trapping element to burn the particulates trapped in the trapping element.

According to the invention, there is provided an exhaust gas purification device, comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ absorbed therein when a concentration of the oxygen in the exhaust gas flowing into the $NO_x$ absorbent decreases, a trapping element arranged in the exhaust passage upstream of the $NO_x$ absorbent for trapping particulates, and a discharging element for discharging the particulates from the trapping element.

Further, according to the invention, an additional trapping element is arranged in the exhaust passage downstream of the $NO_x$ absorbent for trapping the particulates discharged by the discharging element.

Further, according to the invention, the additional trapping element has a trapping filter.

Further, according to the invention, the trapping element has a trapping filter.

According to the invention, there is provided an exhaust gas purification device, comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ absorbed therein when a concentration of the oxygen in the exhaust gas flowing into the $NO_x$ absorbent decreases, a trapping element arranged in the exhaust passage upstream of the $NO_x$ absorbent for trapping particulates, a processing element for processing the particulates trapped in the trapping element to regenerate the trapping element, and an air-fuel ratio control element for controlling the air-fuel ratio of the exhaust gas flowing into the $NO_x$ absorbent to make the air-fuel ratio a stoichiometric ratio or rich when the regeneration of the trapping element is carried out.

Further, according to the invention the air-fuel ratio control element has bypass passage branched from the exhaust passage upstream of the trapping element and connected to the exhaust passage downstream of the trapping element for bypassing the trapping element, and a flow direction changing valve for changing a flow direction of the exhaust gas between the flow directions directed to the trapping element and to the exhaust gas bypass passage, and the flow direction changing valve is controlled to change the flow direction of the exhaust gas from the flow direction directed to the trapping element to the flow direction directed to the exhaust gas bypass passage when the regeneration of the trapping element is carried out.

Further, according to the invention the trapping element has a trapping filter.

Further, according to the invention the processing element has a heater for heating the trapping element to burn the particulates trapped in the trapping element.

The present invention may more fully understood from the description of the preferred embodiments of the invention set forth below, together with the accompanying drawings.

DESCRIPTION OF THE PREFERRED EMBODIMENT

Figure 1:
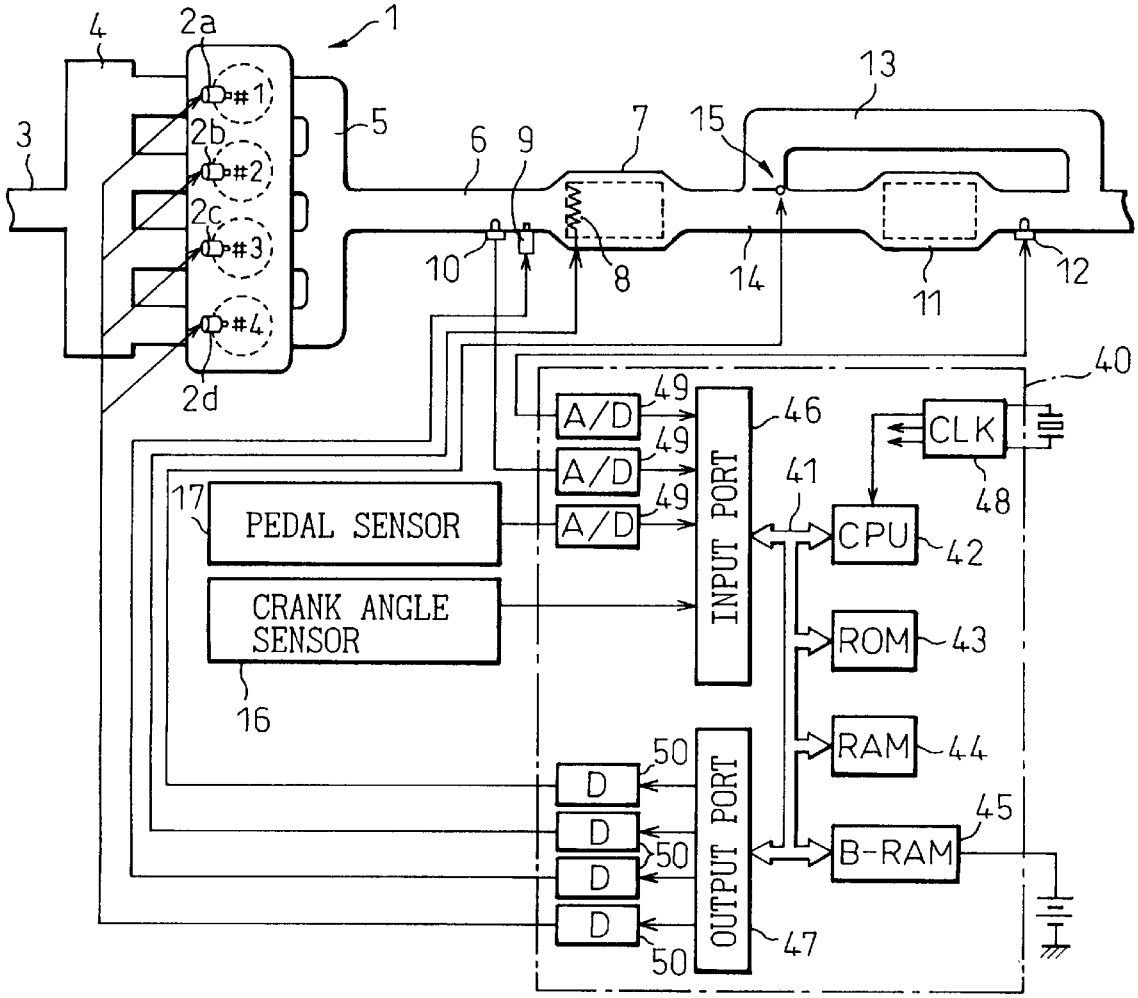
FIG. 1 is a view of an engine with an exhaust gas purification device of the first embodiment.

The invention will be explained by referring to the drawings. FIG. 1 shows an engine employing an exhaust gas purification device of the first embodiment. The engine is a compression combustion engine, and thus, the air-fuel ratio of the exhaust gas is lean in the major range of the engine operation. However, the purification device of the first embodiment can be employed in a so-called lean burn engine in which the air-fuel ratio of the exhaust gas is lean in the major range of the engine operation.

In FIG. 1, 1 denotes an engine body, and #1–#4 denote cylinders formed in the engine body 1. Fuel injectors 2*a*–2*d*are arranged in the cylinders #1–#4, respectively for injecting fuel (including hydrocarbon) into the respective cylinders. An intake passage 3 is connected to the cylinders #1–#4 via an intake manifold 4. The cylinders #1–#4 are connected to an exhaust passage 6 via an exhaust manifold 5.

A trapping filter 7 as a trapping element is arranged in the exhaust passage 6 for trapping an exhaust particulates discharged from the engine. The filter 7 has a small mesh sufficient to trap the particulates. The filter 7 can trap the particulates from the exhaust gas when the exhaust gas flows through the filter 7. Further, a heater 8 as a heating element is arranged at an upstream end of the filter 7 for heating the upstream end of the filter 7 when the filter 7 should be regenerated. It is noted that a heater may be arranged in an intermediate portion or a downstream end of the filter 7 as desired.

An air injector 9 is arranged in the exhaust passage 6 upstream of the filter 7 for injecting an air into the filter 7 when the filter 7 should be regenerated. Further, a pressure sensor 10 as a pressure detecting element is arranged in the exhaust passage 6 upstream of the air injector 9 for detecting a pressure, i.e., exhaust pressure in the exhaust passage upstream of the filter 7. As described below in more detail, the pressure sensor 10 also serves as a judgement element for judging if the filter 7 should be regenerated.

A $NO_x$ absorbent 11 as a $NO_x$ absorbing element is arranged in the exhaust passage 6 downstream of the filter 7 for absorbing $NO_x$ in the exhaust gas. The absorbent 11 absorbs $NO_x$ when the air-fuel ratio of the exhaust gas flowing into the absorbent is lean. Further, the absorbent 11 discharges $NO_x$ absorbed therein when a concentration of oxygen in the exhaust gas flowing into the absorbent decreases.

An air-fuel ratio sensor 12 is arranged in the exhaust passage downstream of the absorbent 11 for detecting an air-fuel ratio of the exhaust gas.

An exhaust gas bypass passage 13 branches from the exhaust passage 6 between the filter 7 and the absorbent 11. The bypass passage 13 connects to the exhaust passage 6 downstream of the absorbent 11. The bypass passage 13 causes the exhaust gas to bypass the absorbent 11.

A flow direction changing valve 15 is arranged in a portion of the exhaust passage 6 from which the bypass passage 13 branches. The valve 15 changes the flow direction of the exhaust gas between the directions directed to the absorbent 11 and to the bypass passage 13.

The engine of the first embodiment comprises an electronic control unit 40. The unit 40 is a digital computer, and comprises a CPU (microprocessor) 42, a ROM (read only memory) 43, a RAM (random access memory) 44, a B-RAM (back up RAM) 45, an input port 46, an output port 47 and a clock generator 48, which are interconnected by a bidirectional lens 41.

The pressure sensor 10 and air-fuel ratio sensor 12 are connected to the input port 46 via corresponding AD converters 49.

Further, the engine comprises a crank angle sensor 16 for detecting an angular position of the crank shaft. The sensor 16 is directly connected to the input port 46. In the first embodiment, the engine speed is calculated on the basis of the detected crank angular position. Further, the engine comprises a pedal sensor 17 for detecting an amount of depression of the acceleration pedal. The pedal sensor 17 is connected to the input port 46 via a corresponding AD converter 49. The output port 47 is connected to the fuel injectors 2*a*–2*d*, the air injector 9, the heater 8 and the changing valve 15.

A $NO_x$ purification process and a filter regeneration process in the purification device of the first embodiment will be explained. First, the $NO_x$ purification process in the purification device will be explained.

The air-fuel ratio of the exhaust gas is lean in the major range of the engine operation, and the changing valve 15 is controlled to cause the exhaust gas to flow into the $NO_x$ absorbent 11.

The particulates in the exhaust as are trapped by the trapping filter 7. Further, $NO_x$ in the exhaust gas is absorbed in the absorbent 11. Therefore, the exhaust gas without the particulates and $NO_x$ is discharged to the downstream of the absorbent 11 in the major range of the $NO_x$ purification process.

In the $NO_x$ purification process, the concentration of the oxygen is caused to be decreased to discharge $NO_x$ from the absorbent 11 by increasing the amount of the fuel injected from the fuel injectors for driving the engine or by injecting the additional fuel from the fuel injector during the engine combustion or exhaust stroke in addition to the injection of the fuel for driving the engine when a predetermined period is elapsed. On the discharge of $NO_x$, the fuel, i.e., hydrocarbon (HC) and/or carbon oxide (CO) reduces $NO_x$ to purify the same. Therefore, during the discharge of $NO_x$, the exhaust gas without the particulates and $NO_x$ is discharged to the downstream of the absorbent 11.

It is noted that HC and CO supplied to the absorbent are completely consumed to reduce $NO_x$, and are not discharged to the downstream of the absorbent 11. For this purpose, in the first embodiment, the amount of HC and CO supplied to the absorbent 11 is decreased when the air-fuel ratio sensor 12 detects that the air-fuel ratio is rich, and the amount of HC and CO supplied to the absorbent 11 is increased when the air-fuel ratio sensor 12 detects that the air-fuel ratio is lean. Further, in the first embodiment, HC and CO serve as a reducing agent for purifying $NO_x$. Further, the predetermined period is set at a time immediately before the amount of $NO_x$ absorbed in the absorbent 11 exceeds the capacity of the absorbent 11 to absorb $NO_x$ therein on the basis of the engine speed and the engine load which is calculated on the basis of the amount of the depression of the acceleration pedal.

The regeneration process of the trapping filter 7 in the purification device will be explained. First, it is judged if the filter 7 should be regenerated on the basis of the exhaust pressure detected by the pressure sensor 10. It is judged that the large amount of the particulates is trapped and the filter 7 should be regenerated when the exhaust pressure is higher than a predetermined pressure. On the other hand, it is judged that the small amount of the particulates is trapped and the filter 7 does not need to be regenerated when the exhaust pressure is lower than the predetermined pressure. The pressure sensor 10 serves ad a judgement element for judging if the filter 7 should be regenerated.

When it is judged that the filter 7 should be regenerated, the changing valve 15 is controlled to cause the exhaust gas to flow into the bypass passage 13, and the filter 7 is heated by the heater 8. During the heating of the filter 7, air is introduced into the filter 7 as required to burn the particulates trapped in the filter 7. In the above process, the particulates trapped in the filter 7 are burned, and thus are eliminated from the filter 7.

On the burning of the particulates, $SO_x$ adsorbed on the particulates is discharged from the filter 7. However, the exhaust gas bypasses the absorbent 11, and flows directly into the exhaust passage 6 downstream of the absorbent 11. Therefore, the absorbent 11 does not absorb $SO_x$, and thus the capacity of the absorbent 11 to absorb $NO_x$ is not decreased.

It is noted that the burning of the particulates trapped in the filter 7 may be achieved by increasing the combustion temperature in the cylinders to introduce the exhaust gas having a high temperature into the filter 7 instead of using the heater. Further, the burning of the particulates trapped in the filter is facilitated by decreasing the amount of the intake air by means of a throttle valve arranged in the intake passage to decrease the amount of the exhaust gas flowing into the filter 7.

Figure 2:
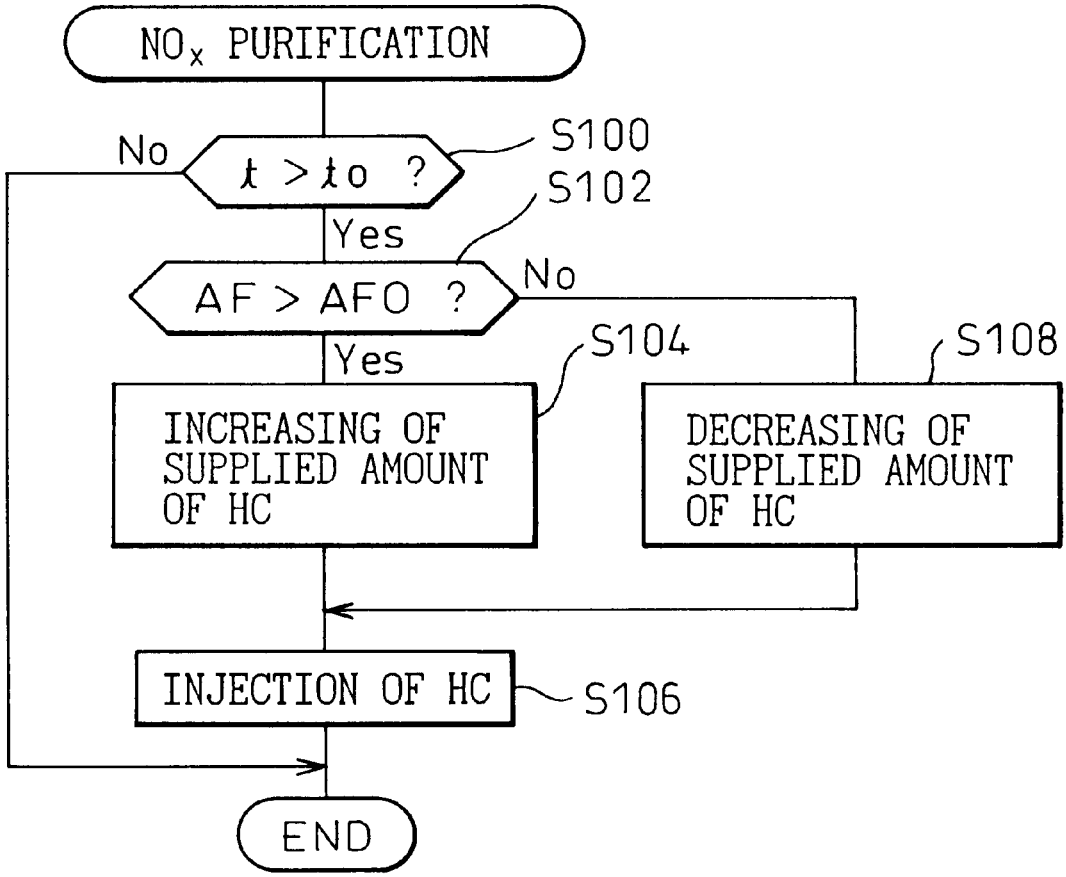
FIG. 2 is a flowchart of $NO_x$ purification of the first embodiment.

An $NO_x$ purification process of the first embodiment will be explained, referring to the flowchart of FIG. 2.

At step 100, it is judged if the period from the time at which HC or CO is supplied to the absorbent 11 last time is larger than the predetermined period ($t>t_0$). When it is judged that $t>t_0$, it is judged that HC or CO does not need to be supplied to the absorbent 11, and the routine is ended. On the other hand, when it is judged that $t\leqq t_0$, it is judged that HC or CO should be supplied to the absorbent 11, the routine proceeds to step 102 where it is judged if the presently detected air-fuel ratio AF of the exhaust gas downstream of the absorbent 11 is larger than the predetermined air-fuel ratio AFO (AF>AFO). In this embodiment, the predetermined air-fuel ratio AFO is a stoichiometric air-fuel ratio. When it is judged that AF>AFO, it is judged that the amount of the HC or CO to be supplied to the absorbent 11 should be increased since the amount of HC or CO is not sufficient, the routine proceeds to step 104 where the amount of HC or CO to be supplied to the absorbent 11 is increased, the routine proceeds to step 106 where the increased amount of HC or CO is injected from the fuel injectors, and the routine is ended. On the other hand, when it is judged that AF≦AFO, it is judged that HC or CO flows out from the absorbent 11, the routine proceeds to step 108 where the amount of HC or CO to be supplied to the absorbent 11 is decreased, the routine proceeds to step 106 where the decreased amount of HC or CO is injected from the fuel injectors, and the routine is ended. Alternatively, when it is judged that AF≦AFO in step 102, the injection of HC or CO may be stopped.

Figure 3:
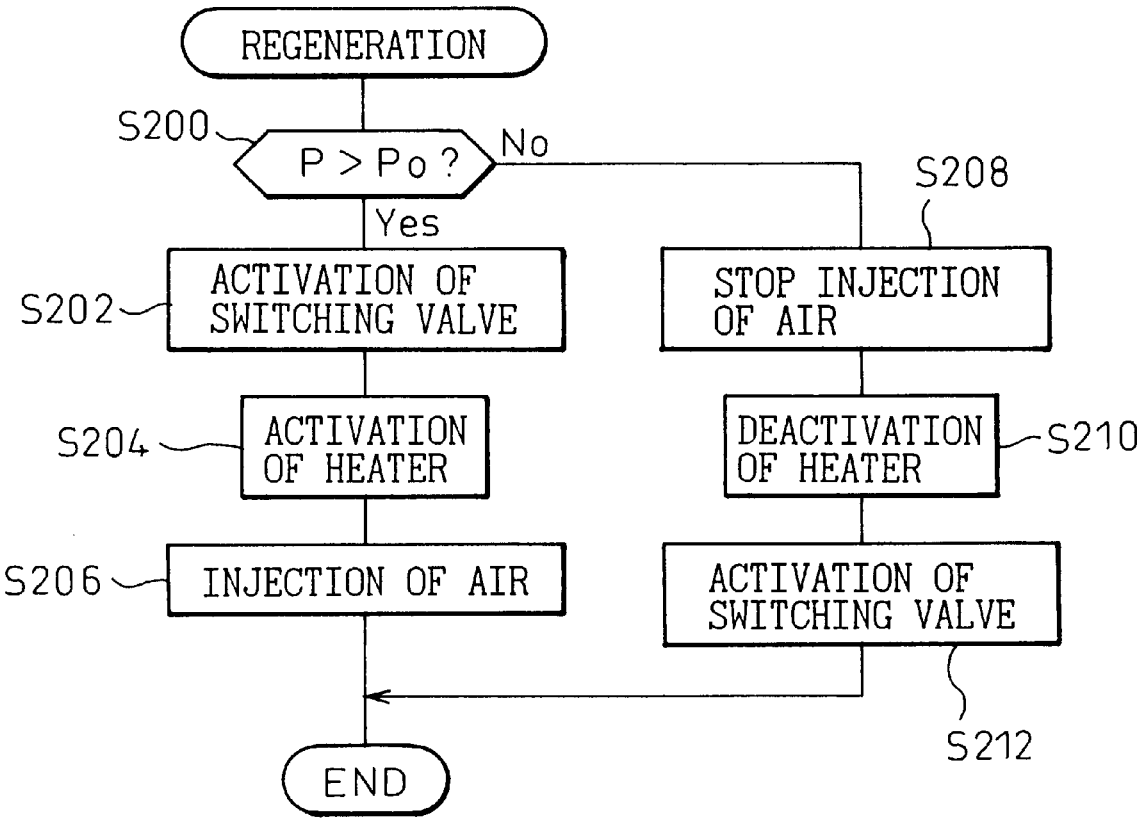
FIG. 3 is a flowchart of regeneration of a trapping filter of the first embodiment.

The regeneration process of the trapping filter of the first embodiment will be explained, referring to the flowchart of FIG. 3.

First, in step 200, it is judged if the exhaust pressure P upstream of the filter 7 is higher than the predetermined pressure $P_0$ ($P>P_0$). When it is judged that $P>P_0$, it is judged that the regeneration of the filter 7 should be carried out since the large amount of the particulates accumulated in the filter 7 may restrict the discharge of the exhaust gas from the engine, the routine proceeds to step 202 where the changing valve 15 is activated to cause the exhaust gas to bypass the absorbent 11, the routine proceeds to step 204 where the heater 8 is activated to burn the particulates in the filter 7, the routine proceeds to step 206 where the air is injected from the air injector to facilitate the burning of the particulates, and the routine is ended. On the other hand, when it is judged that $P\leqq P_0$, it is judged that the regeneration of the filter 7 does not need to be carried out since the amount of the particulates accumulated in the filter is relatively small, or it is judged that the regeneration of the filter 7 is completed, the routine proceeds to step 208 where the injection of the air from the air injector 9 is stopped, the routine proceeds to step 210 where the heater 8 is deactivated, the routine proceeds to step 212 where the changing valve 15 is activated to cause the exhaust gas to flow into the absorbent 11, and the routine is ended.

The exhaust gas purification device of the second embodiment will be explained. A reducing agent such as NO, HC and SOF (soluble organic fraction) is included in the exhaust gas. According to the first embodiment, the reducing agent flows into the filter 7 and reduces the large amount of the oxygen when the regeneration of the filter 7 is carried out. Therefore, the amount of the oxygen is not sufficient to burn the particulates in the trapping filter 7. Thus, it takes a long time to completely burn the particulates trapped in the filter 7. The exhaust gas does not flow into the absorbent 11 during the regeneration of the filter 7. Thus, if it takes a long time to complete the regeneration of the filter, the large amount of $NO_x$ may be discharged to the downstream of the absorbent 11.

To overcome the shortage of the oxygen, it is necessary to make the air-fuel ratio of the engine operation leaner, or to increase the amount of the air injected from the air injector 9. However, the leaner air-fuel ratio of the engine operation leads to the decreasing of the engine output. Further, the air injector may not inject the increased amount of the air. Further, air injection may increase the cost of the purification device. To solve the above problems, the consumption of the oxygen by HC, CO or SOF in the trapping filter is prevented.

Figure 4:
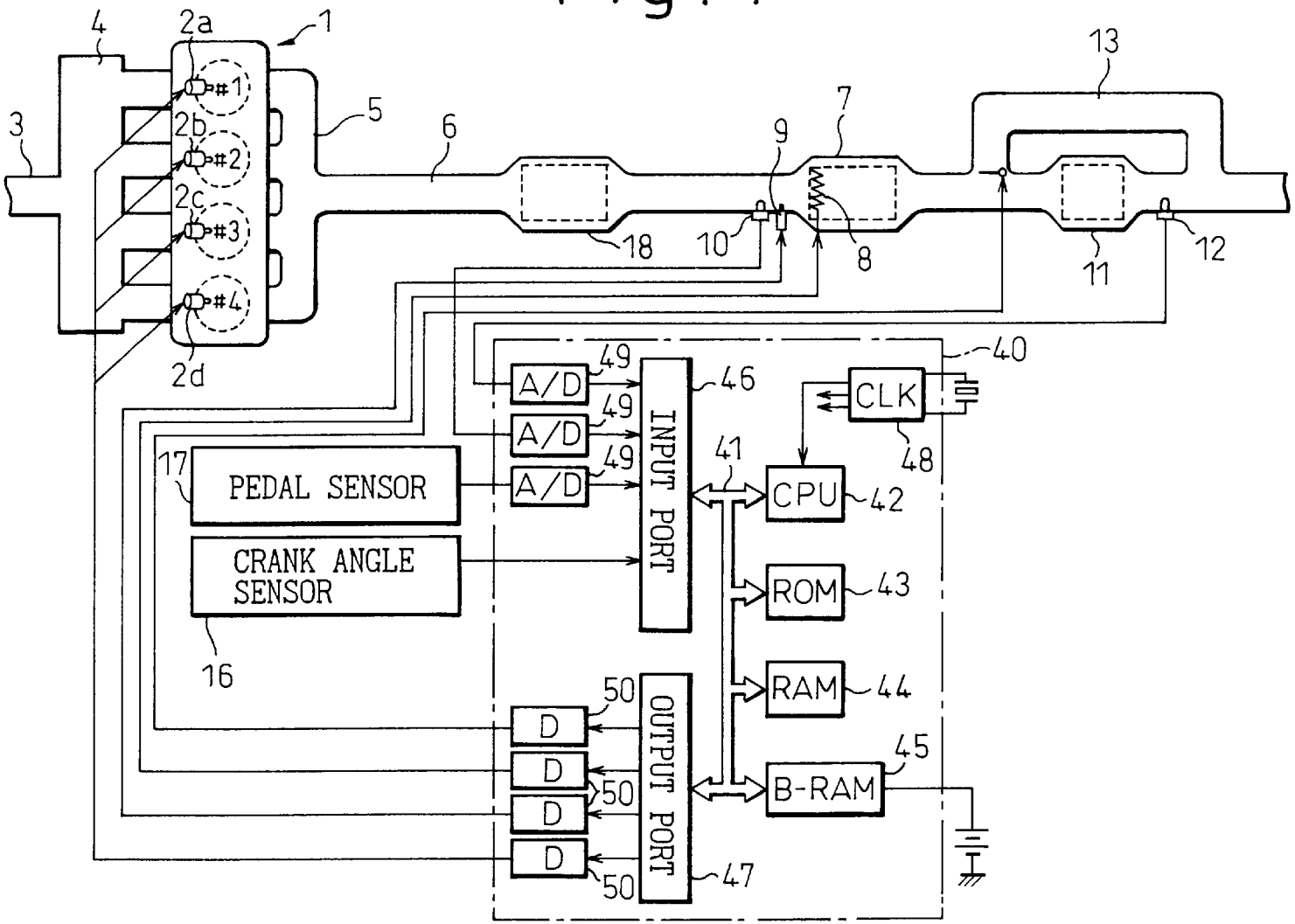
FIG. 4 is a view of an engine with an exhaust gas purification device of the second embodiment.
Figure 5:
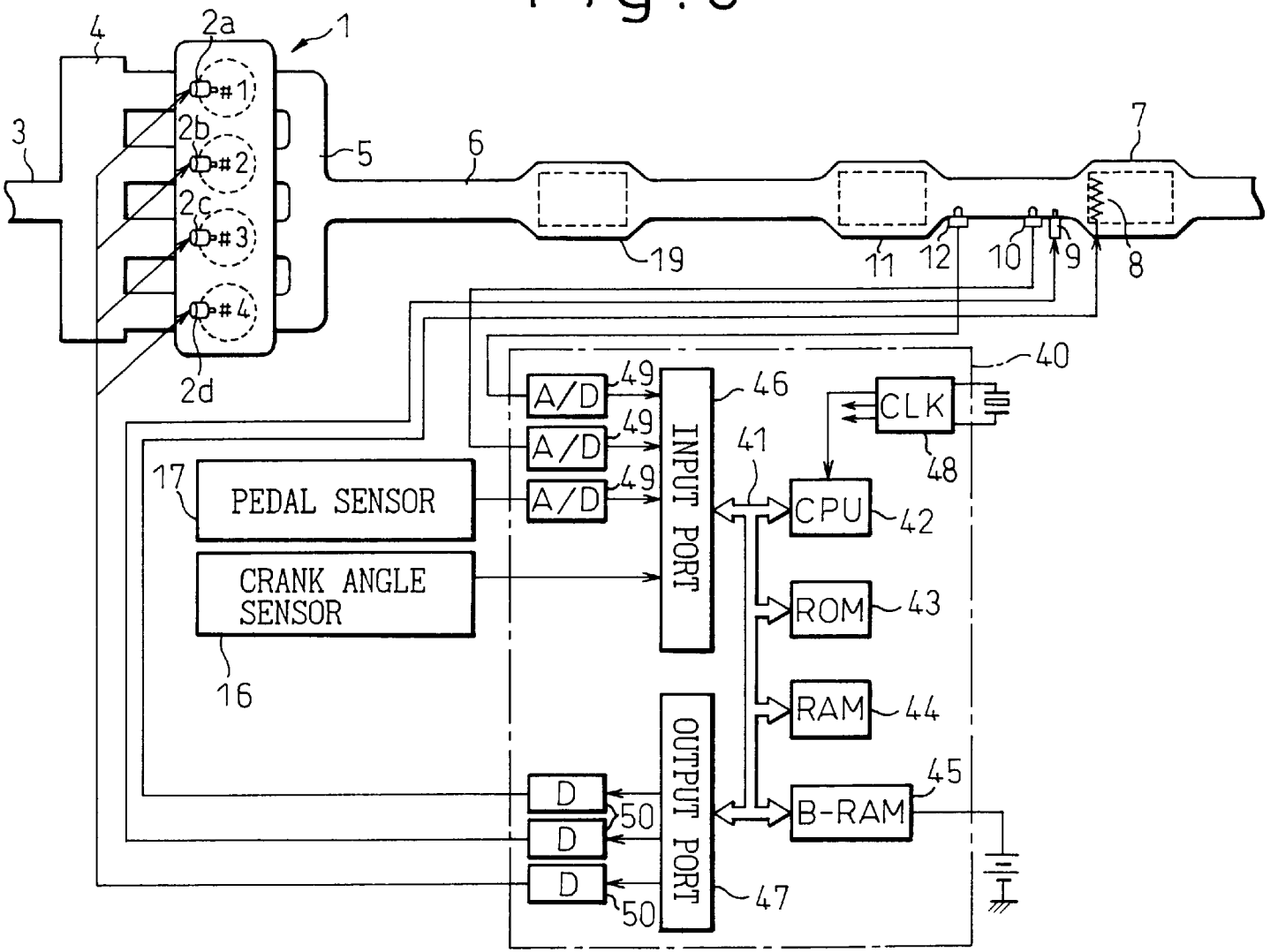
FIG. 5 is a view of an engine with an exhaust gas purification device of the third embodiment.

As shown in FIG. 4, in the second embodiment, an oxidizing catalyst 18 is arranged in the exhaust passage 6 between the engine body 1 and the trapping filter 7, for oxidizing the reducing agent such as NO, HC and SOF. Other components of the second embodiment are the same as those of the first embodiment.

According to the second embodiment, the oxidizing catalyst 18 oxidizes the reducing agent such as NO, HC or SOF. Therefore, the oxygen is not reduced by the reducing agent in the filter 7 during the regeneration of the filter 7. Thus, the particulates trapped in the filter 7 is completely burned within a short period. Thus, the limited amount of $NO_x$ is discharged to the downstream of the absorbent 11 even during the regeneration of the filter 7.

Further, the absorbent 11 can easily absorb $NO_2$ compared with NO. According to the second embodiment, the oxidizing catalyst 18 oxidizes NO to $NO_2$. Therefore, NOx in the form of $NO_2$ transformed from NO by the oxidizing catalyst 18 flows into the absorbent 11 when the regeneration of the filter 7 is not carried out. Thus, the absorbent 11 can easily absorb $NO_x$.

The $NO_x$ purification process and the regeneration process of the filter of the second embodiment are the same as those in the first embodiment.

The exhaust gas purification device of the third embodiment will be explained. As shown in FIG. 3, a trapping body 19 as a trapping element is arranged in the exhaust passage 6 for temporarily trapping the particulates in the exhaust gas and discharging the trapped particulates when a predetermined period is elapsed. The trapping body 19 is porous. The particulates are temporarily trapped by the pores of the trapping body 19. However, the trapped particulates are discharged to the exhaust passage 6 downstream of the trapping body 19 by the exhaust gas. The absorbent which is the same as that of the first embodiment is arranged in the exhaust passage 6 downstream of the trapping filter 19. Further, the trapping filter which is the same as that of the first embodiment is arranged in the exhaust passage 6 downstream of the absorbent 11.

Other components are the same as those in the first embodiment. It is noted that the bypass passage 13 and the changing valve 15 are eliminated.

The operation of the purification device of the third embodiment will be explained.

As described above, the particulates in the exhaust gas are temporarily trapped by the trapping body 19. Further, $SO_x$ is absorbed on the particulates trapped in the trapping body 19. Therefore, the particulates are discharged from the trapping body 19 together with the $SO_x$. $SO_x$ is not absorbed in the absorbent 11 and can pass through the absorbent 11 since $SO_x$ is adsorbed on the particulates.

The particulates with $SO_x$ are trapped by the trapping filter 7 after the particulates pass through the absorbent 11. As in the first embodiment, the filter 7 is regenerated when the exhaust pressure is larger than the predetermined pressure. Accordingly, the capacity of the absorbent to absorb $NO_x$ is not decreased due to $SO_x$.

Figure 6:
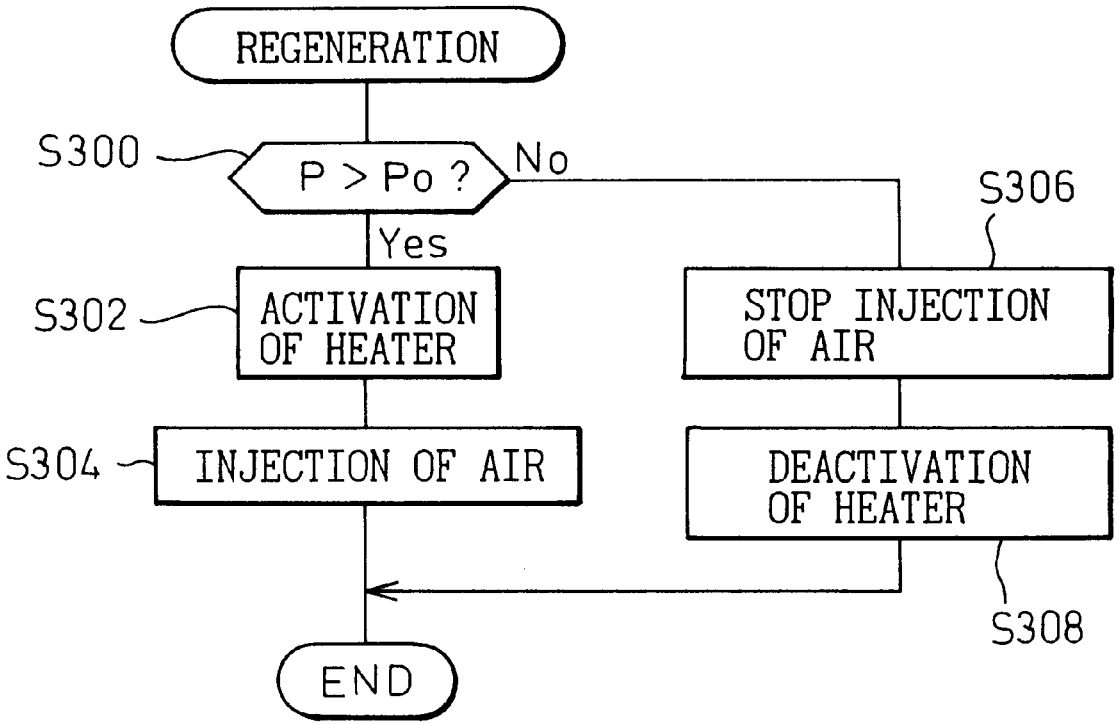
FIG. 6 is a flowchart of regeneration of a trapping filter of the third embodiment.

The regeneration process of the trapping filter of the third embodiment will be explained, referring to the flowchart of FIG. 6. It is noted that the $NO_x$ purification process of the third embodiment is the same as that of the first embodiment.

First, in step 300, it is judged if the exhaust pressure P upstream of the filter 7 is larger than the predetermined pressure $P_0$ ($P>P_0$) When it is judged that $P>P_0$, it is judged that the regeneration of the filter 7 should be carried out since the large amount of the paticulates accumulated in the filter 7 may restrict the discharging of the exhaust gas from the engine, the routine proceeds to step 302 where the heater 8 is activated to burn the particulates in the trapping filter 7, the routine proceeds to step 304 where the air is injected from the air injector 9 to facilitate the burning of the particulates, and the routine is ended. On the other hand, when it is judged that $P \leqq P_0$, it is judged that the regeneration of the filter does not need to be carried out since the small amount of the particulates are accumulated on the trapping filter 7, or it is judged that the regeneration of the filter 7, is completed, the routine proceeds to step 306 where the injection of the air from the air injector is stopped, the routine proceeds to step 308 where the heater 8 is deactivated, and the routine is ended.

The exhaust gas purification device of the fourth embodiment will be explained.

Figure 7:
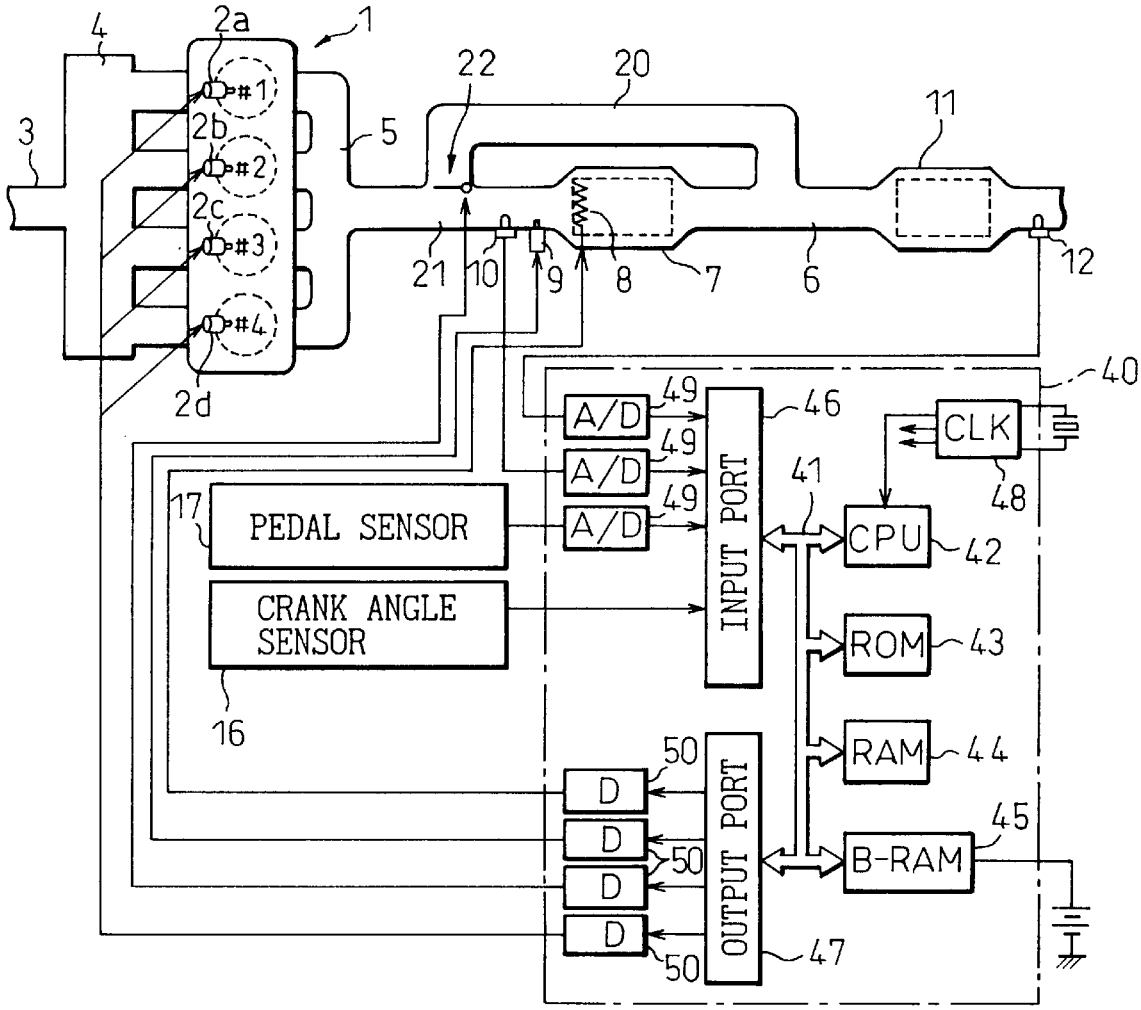
FIG. 7 is a view of an engine with an exhaust gas purification device of the fourth embodiment.

As shown in FIG. 7, the bypass passage 20 branches from the exhaust passage 6 upstream of the trapping filter 7 for bypassing the filter 7. The bypass passage 20 is connected to the exhaust passage 6 between the filter 7 and the absorbent 11. A changing valve 22 is arranged in a portion 21 of the exhaust passage 6 from which the bypass passage 20 branches, for changing the flow direction of the exhaust gas between the directions directed to the filter 7 and to the bypass passage 20.

Other components are the same as those of the first embodiment.

The operation of the purification device will be explained. The $NO_x$ purification process of the fourth embodiment is the same as that of the first embodiment.

The changing valve 22 is controlled to cause the exhaust gas to flow into the bypass passage 20 when the regeneration of the filter 7 should be carried out. At the same time, the filter 7 is heated by the heater 8. Further, the air is injected from the air injector 9 as required. Accordingly, the particulates trapped in the filter 7 are burned and eliminated.

In the fourth embodiment, the exhaust gas flowing into the absorbent 11 includes the exhaust gas direct from the engine and the exhaust gas passing through the filter 7. If the air-fuel ratio of the exhaust gas flowing into the absorbent 11 is lean, $SO_x$ separated from the particulates during the regeneration of the filter 7 may be absorbed in the absorbent 11. Therefore, the capacity of the absorbent 11 to absorb $NO_x$ is decreased.

To avoid this problem, according to the fourth embodiment, the air-fuel ratio of the exhaust gas discharged from the engine is caused to be rich to make the air-fuel ratio of the exhaust gas flowing into the absorbent 11 a stoichiometric ratio or rich on the basis of the air-fuel ratio of the exhaust gas discharged from the filter 7. Thus, $SO_x$ is not absorbed in the absorbent 11 since the air-fuel ratio of the exhaust gas flowing into the absorbent 11 is the stoichiometric ratio or rich. Therefore, the capacity of the absorbent 11 to absorb $NO_x$ is not decreased.

It is noted that the air-fuel ratio of the exhaust gas discharged from the engine is controlled to make the air-fuel ratio of the exhaust gas discharged from the absorbent 11 the stoichiometric ratio. Therefore, the exhaust gas discharged from the absorbent 11 does not include HC.

Figure 8:
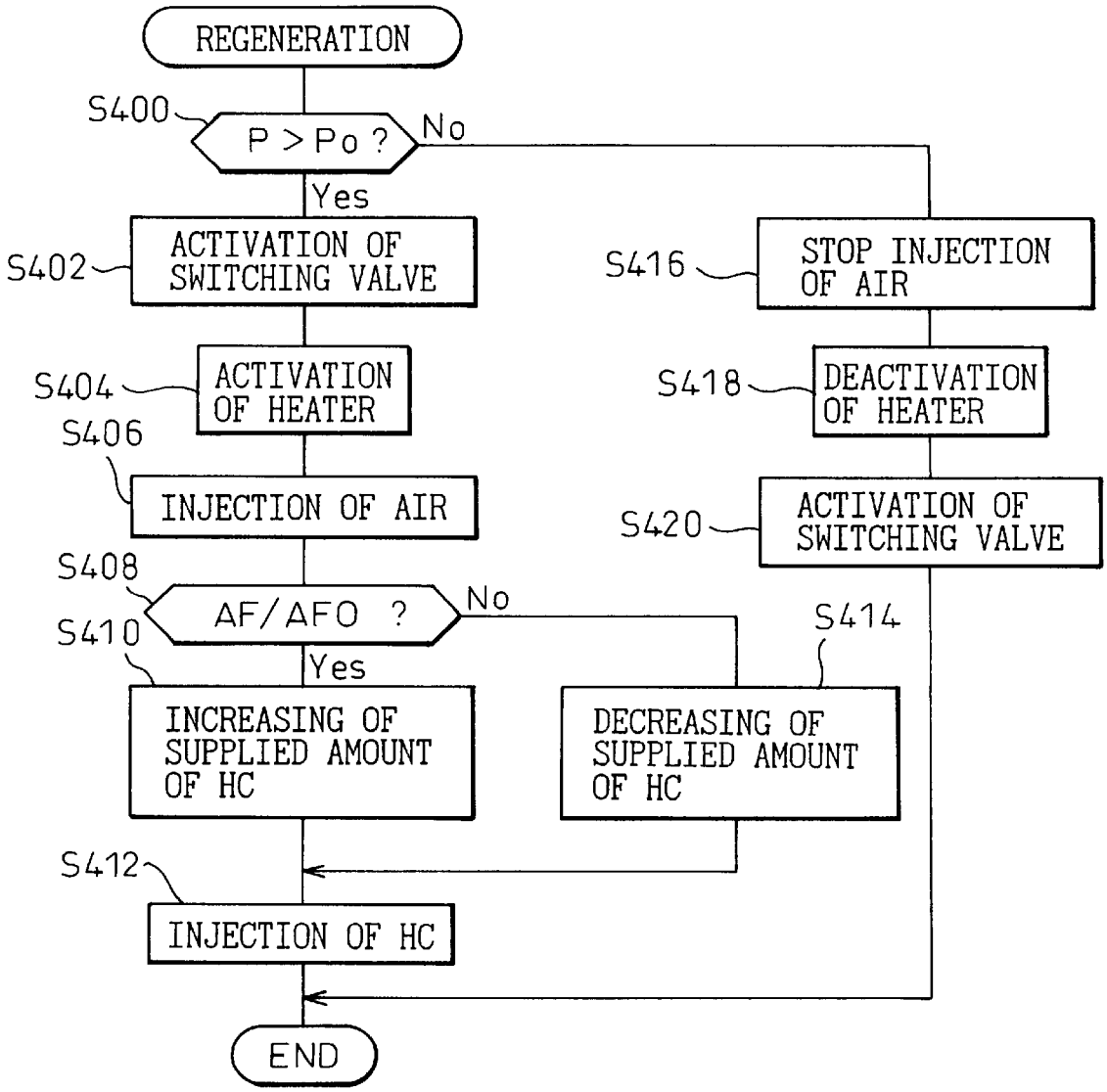
FIG. 8 is a flowchart of regeneration of a trapping filter of the fourth embodiment.

The regeneration of the filter of the fourth embodiment will be explained, referring to the flowchart of FIG. 8. It is noted that the $NO_x$ purification process of the fourth embodiment is the same as that of the first embodiment.

First, in step 400, it is judged if the exhaust pressure P upstream of the filter 7 is larger than the predetermined pressure $P_0$ ($P>P_0$). When it is judged that $P>P_0$, it is judged that the regeneration of the filter 7 should be carried out since the large amount of the particulates accumulated in the filter 7 may restrict the discharging of the exhaust gas from the engine, the routine proceeds to step 402 where the changing valve 22 is activated to cause the exhaust gas to bypass the filter 7, the routine proceeds to step 404 where the heater 8 is activated to burn the particulates in the filter 7, the routine proceeds to step 406 where the air is injected from the air injector 9 to facilitate the burning of the particulates, and the routine proceeds to step 408. On the other hand, when it is judged that $P \leqq P_0$, it is judged that the regeneration of the filter 7 does not need to be carried out since the amount of the particulates accumulated in the filter 7 is relatively small, or it is judged that the regeneration of the filter 7 is completed, the routine proceeds to step 416 where the injection of the air from the air injector 9 is stopped, the routine proceeds to step 418 when the heater 8 is deactivated, the routine proceeds to step 420 where the changing valve 22 is activated to cause the exhaust gas to flow into the absorbent 11, and the routine is ended.

In step 408, it is judged if the presently detected air-fuel ratio AF of the exhaust gas downstream of the absorbent 11 is larger than the predetermined air-fuel ratio AFO (AF>AFO). When it is judged that AF>AFO, it is judged that the amount of HC to be supplied to the absorbent 11 should be increased since the amount of HC is not sufficient, the routine proceeds to step 410 where the amount of HC to be supplied to the absorbent 11 is increased, the routine proceeds to step 412 where the increased amount of HC is injected from the fuel injectors, and the routine is ended. On the other hand, when it is judged that AF≦AFO, it is judged that HC flows out from the absorbent 11, the routine proceeds to step 414 where the amount of HC to be supplied to the absorbent 11 is decreased, the routine proceeds to step 412 where the decreased amount of HC is injected from the fuel injectors, and the routine is ended. Alternatively, when it is judged that AF≦AFO in step 408, the injection of HC may be stooped.

While the invention has been described by reference to specific embodiments chosen for purposes of illustration, it should be apparent that numerous modifications can be made thereto by these skilled in the art without departing from the basic concept and scope of the invention.

What is claimed is:

1. An exhaust gas purification device, comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ therein when a concentration of the oxygen in the exhaust gas flowing into the $NO_x$ absorbent decreases, a trapping element arranged in the exhaust passage upstream of the $NO_x$ absorbent for trapping particulates, a processing element for processing the particulates trapped in the trapping element to regenerate the trapping element, and a preventing element for preventing the exhaust gas flowing out of the trapping element from flowing into the $NO_x$ absorbent when the trapping element is regenerated.

2. The exhaust gas purification device according to claim 1, wherein the preventing element has an exhaust gas bypass passage branched from a portion of the exhaust passage between the trapping element and the $NO_x$ absorbent for bypassing the $NO_x$ absorbent, and a flow direction changing valve for changing a flow direction of the exhaust gas between the flow directions directed to the $NO_x$ absorbent and to the exhaust gas bypass passage, and the flow direction changing valve is controlled to change the flow direction of the exhaust gas from the flow direction directed to the $NO_x$ absorbent to the flow direction directed to the exhaust gas bypass passage when the regeneration of the trapping element is carried out.

3. The exhaust gas purification device according to claim 1 wherein the trapping element has a trapping filter.

4. The exhaust gas purification device according to claim 1 wherein the processing element has a heater for heating the trapping element to burn the particulates trapped in the trapping element.

5. An exhaust gas purification device, comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ absorbed therein when a concentration of the oxygen in the exhaust gas flowing into the $NO_x$ absorbent decreases, a trapping element arranged in the exhaust passage upstream of the $NO_x$ absorbent for trapping particulates, and a discharging element for discharging the particulates from the trapping element.

6. The exhaust gas purification device according to claim 5 wherein an additional trapping element is arranged in the exhaust passage downstream of the $NO_x$ absorbent for trapping the particulates discharged by the discharging element.

7. The exhaust gas purification device according to claim 6 wherein the additional trapping element has a trapping filter.

8. The exhaust gas purification device according to claim 5 wherein the trapping element has a trapping filter.

9. An exhaust gas purification device, comprising a $NO_x$ absorbent arranged in an exhaust passage of an engine for absorbing $NO_x$ therein when an air-fuel ratio of an exhaust gas flowing into the $NO_x$ absorbent is lean, the $NO_x$ absorbent discharging $NO_x$ absorbed therein when a concentration of the oxygen in the exhaust gas flowing into the $NO_x$ absorbent decreases, a trapping element arranged in the exhaust passage upstream of the $NO_x$ absorbent for trapping particulates, a processing element for processing the particulates trapped in the trapping element to regenerate the trapping element, and an air-fuel ratio control element for controlling the air-fuel ratio of the exhaust gas flowing into the $NO_x$ absorbent to make the air-fuel ratio a stoichiometric ratio or rich when the regeneration of the trapping element is carried out.

10. The exhaust gas purification device according to claim 9 wherein the air-fuel ratio control element has a bypass passage branched from the exhaust passage upstream of the trapping element connected to the exhaust passage downstream of the trapping element for bypassing the trapping element, and a flow direction changing valve for changing a flow direction of the exhaust gas between the flow directions directed to the trapping element and to the exhaust gas bypass passage, and the flow direction changing valve is controlled to change the flow direction of the exhaust gas from the flow direction directed to the trapping element to the flow direction directed to the exhaust gas bypass passage when the regeneration of the trapping element is carried out.

11. The exhaust gas purification device according to claim 9 wherein the trapping element has a trapping filter.

12. The exhaust gas purification device according to claim 9 wherein the processing element has a heater for heating the trapping element to burn the particulates trapped in the trapping element.

* * * * *